US009580857B2

(12) United States Patent
Lee et al.

(10) Patent No.: US 9,580,857 B2
(45) Date of Patent: Feb. 28, 2017

(54) CLOTHES TREATING APPARATUS AND OPERATING METHOD THEREOF

(71) Applicant: LG ELECTRONICS INC., Seoul (KR)

(72) Inventors: Hyuksoo Lee, Seoul (KR); Sungmin Ye, Seoul (KR); Seonghwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/579,638

(22) Filed: Dec. 22, 2014

(65) Prior Publication Data

US 2015/0101209 A1 Apr. 16, 2015

Related U.S. Application Data

(63) Continuation of application No. 13/247,314, filed on Sep. 28, 2011, now Pat. No. 9,103,064.

(30) Foreign Application Priority Data

Sep. 30, 2010 (KR) ..... 10-2010-0095492

(51) Int. Cl.
*D06F 58/24* (2006.01)
*D06F 58/28* (2006.01)
(Continued)

(52) U.S. Cl.
CPC ..... *D06F 58/206* (2013.01); *D06F 58/28* (2013.01); *D06F 58/02* (2013.01);
(Continued)

(58) Field of Classification Search
CPC ..... D06F 58/206; D06F 2058/2864
(Continued)

(56) References Cited

U.S. PATENT DOCUMENTS 5,361,511 A * 11/1994 Brown ..... D06F 58/206 34/77
7,905,098 B2 3/2011 Pham ..... 62/126
(Continued)

FOREIGN PATENT DOCUMENTS

CN 1766208 5/2006
CN 1886628 A 12/2006
(Continued)

OTHER PUBLICATIONS

European Search Report issued in Application No. 11829546.8 dated Jul. 22, 2015.
(Continued)

*Primary Examiner* — Kenneth Rinehart
*Assistant Examiner* — Tavia Sullens
(74) *Attorney, Agent, or Firm* — Ked & Associates LLP

(57) ABSTRACT

A clothes treating apparatus including a drum, an air suction duct forming a flow path of air introduced into the drum, an auxiliary fan introducing air into the air suction duct, an air exhaustion duct forming a flow path of air exhausted from the drum, a main fan exhausting air to the air exhaustion duct from the drum, a condenser heating air sucked into the drum through the air suction duct, an evaporator cooling air exhausted from the drum through the air exhaustion duct, and a compressor and an expander forming a heat pump together with the condenser and the evaporator. The method includes measuring a discharge side pressure of the compressor, and comparing the measured discharge side pressure with a maximum allowable pressure, and determining that the auxiliary fan does not operate when the discharge side pressure is more than the maximum allowable pressure.

20 Claims, 2 Drawing Sheets

(51) Int. Cl.
*D06F 58/20* (2006.01)
*D06F 58/02* (2006.01)

(52) U.S. Cl.
CPC ..... *D06F 2058/287* (2013.01); *D06F 2058/2858* (2013.01); *D06F 2058/2864* (2013.01)

(58) Field of Classification Search
USPC ..... 34/487, 492, 515
See application file for complete search history.

(56) References Cited

U.S. PATENT DOCUMENTS

| | | | | |
|---|---|---|---|---|
| 2005/0066538 | A1* | 3/2005 | Goldberg | D06F 25/00 34/218 |
| 2005/0235660 | A1 | 10/2005 | Pham | |
| 2005/0246920 | A1* | 11/2005 | Yabuuchi | D06F 58/02 34/515 |
| 2006/0032245 | A1 | 2/2006 | Kates | |
| 2007/0068178 | A1* | 3/2007 | Honma | F25B 9/008 62/160 |
| 2009/0165328 | A1 | 7/2009 | Grunert et al. | |
| 2009/0277197 | A1* | 11/2009 | Gambiana | F25B 39/028 62/115 |
| 2010/0077787 | A1 | 4/2010 | Masuda et al. | 62/324.5 |

FOREIGN PATENT DOCUMENTS

| | | | | |
|---|---|---|---|---|
| CN | 1906451 | | | 1/2007 |
| DE | 31 13 471 | A1 | | 10/1982 |
| DE | 44 09 607 | A1 | | 10/1994 |
| DE | 43 30 456 | C1 | | 3/1995 |
| DE | 10 2008 031 495 | A1 | | 1/2010 |
| DE | 10 2008 040 853 | A1 | | 2/2010 |
| EP | 0 999 302 | A1 | | 5/2000 |
| EP | 2 034 084 | A1 | | 3/2009 |
| EP | 2 075 369 | A2 | | 7/2009 |
| JP | S61-5897 | | | 1/1986 |
| JP | 06-007595 | | | 1/1994 |
| JP | 10-263261 | | | 10/1998 |
| JP | 2007-10242 | | | 1/2007 |
| JP | 2007-082588 | A | | 4/2007 |
| JP | 2007-143631 | A | | 6/2007 |
| JP | 2007/143735 | | | 6/2007 |
| JP | 2007143631 | A | * | 6/2007 |
| JP | 2007-244567 | A | | 9/2007 |
| JP | 2007-301130 | A | | 11/2007 |
| JP | 2008/107064 | | | 5/2008 |
| JP | 2009/240838 | | | 10/2009 |
| JP | 2010-63752 | A | | 3/2010 |
| KR | 10-1996-0024190 | A | | 7/1996 |
| KR | 10-2006-0046994 | A | | 5/2006 |
| KR | 10-2011-0029579 | A | | 3/2011 |
| RU | 2011 132 067 | A | | 2/2013 |
| WO | WO 2005/032322 | A2 | | 4/2005 |
| WO | WO 2005/098328 | | | 10/2005 |
| WO | WO 2010/003936 | | | 1/2010 |
| WO | WO 2010/012708 | | | 2/2010 |

OTHER PUBLICATIONS

U.S. Appl. No. 14/007,217, filed Sep. 24, 2013, Kenneth Rinehart.
U.S. Appl. No. 14/570,864, filed Dec. 15, 2014, To Be Assigned.
U.S. Appl. No. 14/570,895, filed Dec. 15, 2014, To Be Assigned.
European Search Report issued in Application No. 12763494.7 dated Feb. 27, 2015.
U.S. Appl. No. 13/247,314, filed Sep. 28, 2011, Gajanan Madbav Prabhu.
U.S. Appl. No. 14/007,217, filed Sep. 24, 2013, To Be Assigned.
Chinese Office Action dated Jan. 7, 2015 (with translation).
U.S. Appl. No. 13/247,314, filed Sep. 28, 2011, Gajanan Madhav Prabhu.
Chinese Office Action issued in Application No. 201280016399.1 dated May 19, 2015 (with English translation).
Final Office Action dated Jan. 7, 2015, issued in U.S. Appl. No. 13/247,314.
U.S. Appl. No. 14/007,217, filed Sep. 24, 2013, Jiping Lu.
U.S. Appl. No. 14/570,864, filed Dec. 15, 2014, Kenneth Rinehart.
U.S. Appl. No. 14/570,895, filed Dec. 15, 2014, Kenneth Rinehart.
Japanese Office Action dated Jan. 5, 2016.
U.S. Office Action issued in U.S. Appl. No. 14/007,217 dated Jan. 21, 2016.
International Search Report and Written Opinion dated Oct. 18, 2012, issued in Application No. PCT/KR2012/002221.
Russian Decision to Grant a Patent dated Aug. 29, 2014 issued in Application No. 2013120070/12 (with English translation).

* cited by examiner

CLOTHES TREATING APPARATUS AND OPERATING METHOD THEREOF

CROSS-REFERENCE TO RELATED APPLICATIONS

This application is a Continuation Application of prior U.S. patent application Ser. No. 13/247,314 filed Sep. 28, 2011, which claims priority under 35 U.S.C. §119 to Korean Application No. 10-2010-0095492 filed on Sep. 30, 2010, whose entire disclosure is hereby incorporated by reference.

BACKGROUND

1. Field

The present invention relates to a clothes treating apparatus and an operating method thereof, and more particularly, to a clothes treating apparatus having a heat pump system, and a method for checking whether an auxiliary fan configured to supply air into a drum of the clothes treating apparatus is in an abnormal state.

2. Background

Generally, a clothes treating apparatus having a drying function, such as a washing machine or a clothes dryer, serves to dry laundry having been completely washed and dehydrated, by introducing the laundry into a drum, by supplying hot blast into the drum, and then by evaporating moisture from the laundry.

Hereinafter, the clothes treating apparatus will be explained with taking a clothes dryer as an example. The clothes dryer includes a drum rotatably installed in a body and having laundry introduced thereinto, a driving motor configured to drive the drum, a blowing fan configured to blow air into the drum, and a heating means configured to heat air introduced into the drum. The heating means may use high-temperature electric resistance heat generated from an electric resistance, or combustion heat generated from gas combustion.

Air exhausted from the drum is in a state of a high temperature and a high humidity due to moisture of the laundry inside the drum. According to a method for processing the air of a high temperature and a high humidity, the clothes dryer may be classified into a condensation type (circulation type) and an exhaustion type. The condensation type clothes dryer is configured to condense moisture included in the air of a high temperature and a high humidity, by circulating and cooling the air into a temperature less than a dew point through a condenser, without exhausting the air to the outside. And, the exhaustion type clothes dryer is configured to directly exhaust the high temperature-high humidity air having passed through the drum to the outside.

In the case of the condensation type clothes dryer, the air has to be cooled into a temperature less than a dew point so as to condense the air exhausted from the drum. And, the air has to be heated by the heating means before being re-supplied into the drum. Here, the air may have the loss of its thermal energy while being cooled. In order to heat the air to a temperature high enough to perform a drying operation, required is an additional heater, etc.

In the case of the exhaustion type clothes dryer, it is also required to exhaust the air of a high temperature and a high humidity to the outside, to introduce external air of a high temperature, and to heat the external air into a desired temperature by the heating means. Especially, high-temperature air exhausted to the outside includes thermal energy transmitted by the heating means. However, the thermal energy is exhausted to the outside, resulting in lowering of the thermal efficiency.

In order to overcome these problems, being proposed is a clothes treating apparatus capable of enhancing the energy efficiency by recovering energy required to generate hot blast, and energy exhausted to the outside without being used. As one example of the clothes treating apparatus, a clothes treating apparatus having a heat pump system is being recently introduced. The heat pump system is provided with two heat exchangers, a compressor and an expander, and enhances the energy efficiency by recovering energy of exhausted hot blast and by re-using the energy to heat air supplied into the drum.

More concretely, the heat pump system is provided with an evaporator at an exhaustion side, and with a condenser at a suction side near the drum. And, the heat pump system transmits thermal energy to a refrigerant through the evaporator, and transmits thermal energy of the refrigerant to air introduced into the drum through the condenser, thereby generating hot blast with using abandoned energy. Here, the heat pump system may further include a heater configured to re-heat air heated while passing through the condenser.

In order for the heat pump system of the clothes dryer to stably operate, heat exchange has to be smoothly performed at the evaporator and the condenser. In the conventional art, air circulates the inside of the clothes dryer by the operation of a main fan disposed below the drum. However, in case of adopting a heat pump system, an auxiliary fan for supplying air to the condenser is separately installed from the main fan so as to accelerate heat exchange of the condenser.

If heat exchange is not smoothly performed at the condenser due to an abnormal state of the auxiliary fan, a refrigerant is overheated to lower the reliability of the product. Furthermore, the amount of power consumption by the compressor is increased due to an overload applied to the compressor. This may lower the energy efficiency. Therefore, whether the auxiliary fan normally operates or not has to be continuously checked while the clothes dryer operates. However, this is difficult since a user cannot easily access to a position where the auxiliary fan is installed, and cannot easily check with his or her naked eyes. More concretely, air flow continues in a state that the main fan is in a steady state and the auxiliary fan is in an abnormal state. This may cause a user to have a difficulty in checking an abnormal state of the auxiliary fan from the outside.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Disclosure of the Invention

Figure 1:
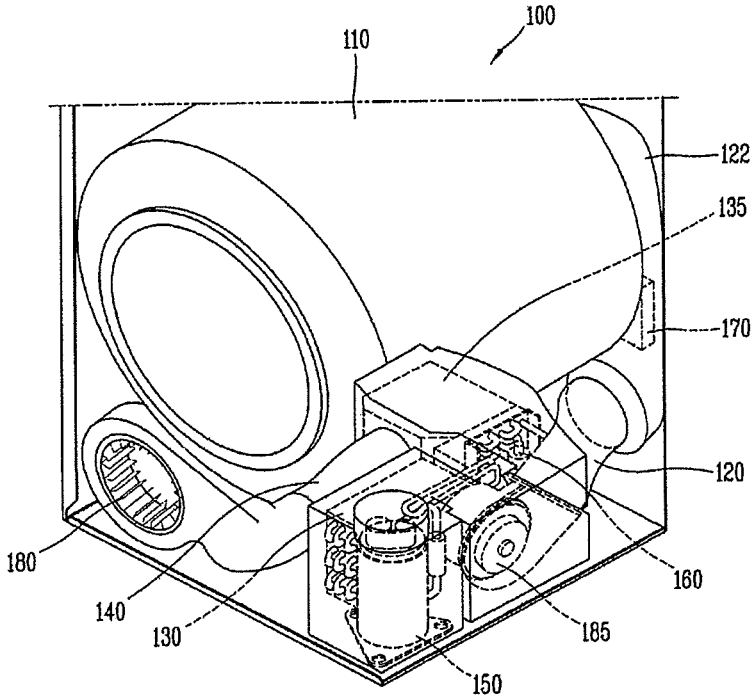
FIG. 1 is a perspective view schematically illustrating an inner structure of a clothes treating apparatus according to one embodiment of the present invention.

Therefore, an object of the present invention is to provide a method capable of rapidly and easily detecting whether an auxiliary fan normally operates or not in a clothes treating apparatus with a heat pump system.

Another object of the present invention is to provide a clothes treating apparatus having a detecting means for rapidly and easily detecting whether an auxiliary fan normally operates or not.

To achieve these and other advantages and in accordance with the purpose of the present invention, as embodied and broadly described herein, there is provided an operating method for a clothes treating apparatus comprising a drum configured to accommodate therein an object to be dried; an air suction duct configured to form a flow path of air introduced into the drum; an auxiliary fan configured to introduce air into the air suction duct; an air exhaustion duct configured to form a flow path of air exhausted from the drum; a main fan configured to exhaust air to the air exhaustion duct from the drum; a condenser disposed to heat air sucked into the drum through the air suction duct; an evaporator disposed to cool air exhausted from the drum through the air exhaustion duct; and a compressor and an expander configured to constitute a heat pump together with the condenser and the evaporator, the method comprising: measuring a discharge side pressure (Pd) of the compressor; and comparing the measured discharge side pressure (Pd) with a maximum allowable pressure (Pm), and determining that the auxiliary fan does not operate when the discharge side pressure (Pd) is more than the maximum allowable pressure (Pm).

The present inventors have certified that an inner pressure of the heat pump system is increased when the auxiliary fan does not operate, since heat transfer in the condenser is not smoothly performed. More concretely, the present inventors have compared a case when the auxiliary fan normally operates with a case when the auxiliary fan does not operate by a user's intention. The present invention has been devised based on the results of this research. According to one aspect of the present invention, the operating method for a clothes treating apparatus may comprise measuring a pressure of a refrigerant discharged from the compressor; and determining that the auxiliary fan does not operate when the measured pressure of the refrigerant is more than a preset value.

Here, whether the auxiliary fan normally operates or not may be determined based on a maximum allowable pressure (Pm), i.e., a maximum pressure of a refrigerant when the auxiliary fan normally operates. More concretely, the maximum allowable pressure (Pm) may be defined as a maximum pressure of a refrigerant when air around the condenser is normally supplied into the condenser in a steady state of the auxiliary fan.

A discharge side pressure of the compressor may be directly measured by using an additional pressure sensor, or may be indirectly measured by measuring a discharge side temperature (Td) of the compressor. More concretely, pressures of a refrigerant may be measured in advance in correspondence to differently-set discharge side temperatures of the refrigerant. These measured values may be compared with each other to indirectly measure a pressure of the refrigerant.

The maximum allowable pressure (Pm) may be determined with consideration of a peripheral temperature (Ta) of the condenser. More concretely, the amount of heat transfer from the condenser may become different according to the peripheral temperature (Ta) of the condenser. This may cause a pressure of the refrigerant to become different. Accordingly, a peripheral temperature (Ta) of the condenser may be measured, and a maximum allowable pressure (Pm) corresponding to the measured peripheral temperature (Ta) may be determined, thereby more precisely determining whether the auxiliary fan is in an abnormal state.

If it is determined that the auxiliary fan is in an abnormal state, more concretely, if it is determined that the auxiliary fan does not operate, the clothes treating apparatus may be stopped such that the clothes dryer is prevented from operating in an abnormal state.

If it is determined that the auxiliary fan does not operate, a rotation speed of the main fan may be increased to indirectly increase the amount of air introduced into the condenser.

To achieve these and other advantages and in accordance with the purpose of the present invention, as embodied and broadly described herein, there is provided a clothes treating apparatus, comprising: a drum configured to accommodate therein an object to be dried; an air suction duct configured to form a flow path of air introduced into the drum; an auxiliary fan configured to introduce air into the air suction duct; an air exhaustion duct configured to form a flow path of air exhausted from the drum; a main fan configured to exhaust air to the air exhaustion duct from the drum; a condenser disposed to heat air sucked into the drum through the air suction duct; an evaporator disposed to cool air exhausted from the drum through the air exhaustion duct; a compressor and an expander configured to constitute a heat pump together with the condenser and the evaporator; a pressure measuring means configured to measure a discharge side pressure (Pd) of the compressor; a temperature measuring means configured to measure a peripheral temperature (Ta) of the condenser; and a controller configured to calculate a maximum allowable pressure (Pm) based on the peripheral temperature (Ta) of the condenser, to compare the calculated maximum allowable pressure (Pm) with the discharge side pressure (Pd), and thereby to determine whether the auxiliary fan operates or not.

The pressure measuring means may include a temperature measuring means configured to measure a discharge side temperature (Td) of the compressor. And, the controller may include a first memory configured to store therein data relating to a correlation between the discharge side temperature (Td) and the discharge side pressure (Pd).

The first memory may store therein a plurality of discharge side pressures (Pd) of the compressor corresponding to a plurality of discharge side temperatures (Td), and the controller may select one of the plurality of discharge side pressures (Pd) stored in the first memory according to a measured discharge side temperature (Td).

The controller may include a second memory having therein a plurality of maximum allowable pressures (Pm) corresponding to a plurality of peripheral temperatures (Ta) of the condenser, and may select one of the plurality of maximum allowable pressures (Pm) stored in the second memory according to a measured peripheral temperature (Ta).

The controller may determine that the auxiliary fan does not operate when the discharge side pressure (Pd) is more than the maximum allowable pressure (Pm).

In the present invention, whether the auxiliary fan operates or not may be rapidly and easily checked without a user's naked eyes. This may enhance the reliability of the clothes treating apparatus, and improve the energy efficiency.

MODES FOR CARRYING OUT THE PREFERRED EMBODIMENTS

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, with reference to the attached drawings, will be explained a clothes treating apparatus having a heat pump system, and an operating method thereof.

Figure 2:
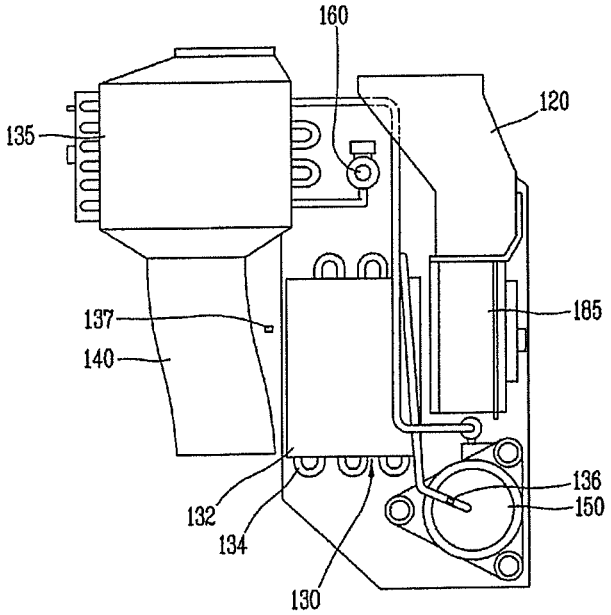
FIG. 2 is a planar view illustrating the clothes treating apparatus of FIG. 1.

FIG. 1 is a perspective view schematically illustrating an inner structure of a clothes treating apparatus according to one embodiment of the present invention, and FIG. 2 is a planar view of the clothes treating apparatus of FIG. 1. Referring to FIGS. 1 and 2, FIG. 1 illustrates a clothes dryer. However, the present invention is not limited to the clothes dryer, but is applicable to any clothes treating apparatuses for drying laundry by supplying hot air into a drum e.g., a washing machine having a drying function, etc. The clothes treating apparatus according to the present invention comprises a body 100 which forms the appearance of a clothes dryer, and a drum 110 rotatably installed in the body. The drum is rotatably supported by a supporter (not shown) at front and rear sides.

An air suction duct 120 which forms part of an air suction flow path toward inside of the drum 110 is installed at a bottom surface of the drum 110, and the end of the air suction duct 120 is connected to the end of a backduct 122. The backduct 122 is extending to an up-down direction of the body 100 between the air suction duct 120 and the drum 110, thereby introducing air having passed through the air suction duct 120 into the drum 110. Accordingly, formed is an air suction flow path through which air is introduced into the drum 110 by the air suction duct 120 and the backduct 122.

Air supplied through the air suction flow path is introduced into the body through an air suction port (not shown) formed on a rear surface or a bottom surface of the body, and then is transferred to the air suction duct 120. For this transfer of the air, an auxiliary fan 185 is installed at the end of the air suction duct 120. That is, air inside the body is introduced into the air suction duct 120 by rotation of the auxiliary fan 185. This may lower a pressure inside the body, thereby causing external air to be introduced into the body through the air suction port.

A condenser 130 is installed at a front side of the auxiliary fan (upper stream side based on an air flow path). The condenser 130 constitutes a heat pump together with an evaporator 135, a compressor 150 and an expander 160 to be later explained. One refrigerant pipe 134 is arranged in a zigzag form, and radiation fins 132 are installed on the surface of the refrigerant pipe 134. Since the auxiliary fan 185 is positioned at a down stream side of the condenser 130, air sucked by the auxiliary fan 185 is heat-exchanged with a refrigerant with contacting the radiation fins 132 of the condenser 130. Then, the air is introduced into the drum in a state of an increased temperature.

A heater 170 is installed in the backduct 122 so as to additionally heat air having not been sufficiently heated by the condenser 103. The heater 170 may be installed at the air suction duct 120. This air heated while passing through the condenser 130 and the heater is introduced into the drum in the form of hot air having a temperature of about 300 .degree. C., and then serves to dry an object to be dried and accommodated in the drum.

Then, the hot air is exhausted to an exhaust air duct 140 by a main fan 180 positioned below the drum 110, and then is heat-exchanged with the evaporator 135 disposed at the end of the exhaust air duct 140. Then, the air is exhausted to outside of the body 100. Since the evaporator 135 has a temperature lower than that of the exhaust air, the exhaust air is cooled to a temperature similar to the room temperature. Accordingly, part of moisture of the exhaust air is condensed, and a humidity of the exhaust air is decreased to be similar to an indoor humidity.

The compressor 150, the condenser 130, the expander 160 and the evaporator 135 constitute a refrigerant compression cycle apparatus, absorb heat from the exhaust air and then transfer the absorbed heat to sucked air. This may reduce the amount of energy consumption. More concretely, a refrigerant circulates on the compressor 150, the condenser 130, the expander 160 and the evaporator 135, sequentially. At an inlet of the condenser 130, the refrigerant is in a state of a high temperature and a high pressure since it has been compressed by the compressor 150.

Once the auxiliary fan 185 normally operates, a sufficient amount of air is transmitted to the condenser to be heat-exchanged with the refrigerant passing through inside of the condenser. As a result, the refrigerant is in a state of a low temperature and a high pressure, and moves to the expander. If a sufficient amount of air is not supplied to the condenser due to an abnormal state of the auxiliary fan 185, heat of the refrigerant is not radiated. Accordingly, a pressure and a temperature of the refrigerant inside the condenser are increased. This may increase a temperature and a pressure inside the heat pump system. Whether the auxiliary fan normally operates or not may be checked by checking a pressure of the refrigerant discharged from the compressor.

A discharge side pressure of the compressor may be directly measured by a pressure sensor, or may be indirectly measured by using a refrigerant temperature. More concretely, a pressure is determined according to a refrigerant temperature in an assumption that other external conditions are same. Accordingly, once a discharge side temperature (Td) of the compressor is measured, a discharge side pressure (Pd) of the compressor may be calculated. For this, a temperature sensor 136 is provided at a discharge side pipe of the compressor 150 in the preferred embodiment.

The amount of heat transfer executed by the condenser between sucked air and a refrigerant may be variable according to temperatures of the refrigerant and the sucked air. More concretely, once the heat pump system normally operates, the discharge side temperature (Td) of the compressor is maintained within a predetermined range. However, the temperature of the sucked air transmitted to the condenser is variable according to a climate or other conditions of a place where the clothes dryer has been installed. Accordingly, a temperature and a pressure of the refrigerant having passed through the condenser are variable according to a temperature of the sucked air in an assumption that the amount of the sucked air transmitted to the condenser is constant.

Even if other conditions are same, the range of a normal pressure of the refrigerant inside the condenser is determined according to a peripheral temperature of the condenser. In order to precisely check whether the heat pump system normally operates or not, a peripheral temperature (Ta) of the condenser is measured, and a pressure range is calculated based on the measured peripheral temperature (Ta). Here, a maximum allowable pressure (Pm) is determined, and is compared with the aforementioned discharge side pressure (Pd). Based on a comparison result, it is checked whether the auxiliary fan 185 normally operates or not. For this, a temperature sensor 137 is provided at a position adjacent to the inlet of the condenser.

Figure 3:
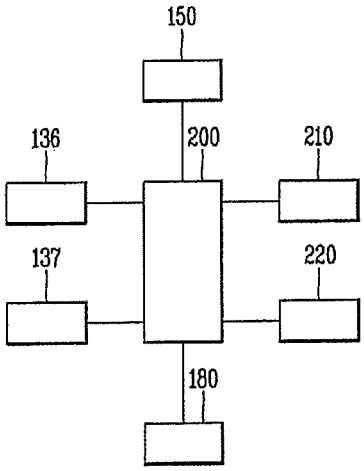
FIG. 3 is a block diagram schematically illustrating a configuration of a controller of the clothes treating apparatus of FIG. 1.

FIG. 3 is a block diagram schematically illustrating a configuration of a controller of the clothes treating apparatus of FIG. 1. Referring to FIG. 3, the two temperature sensors 136 and 137 are connected to a controller 200, and transmit, to the controller 200, a signal regarding the discharge side temperature (Td) of the compressor and the peripheral temperature (Ta) of the condenser. Then, the controller 200 checks whether the auxiliary fan normally operates or not based on the received signal. For this, the controller 200 includes a first memory 210 having therein information on each discharge side pressure (Pd) corresponding to each discharge side temperature (Td), and a second memory 220 having therein information on each maximum allowable pressure (Pm) corresponding to each peripheral temperature (Ta) of the condenser.

The controller 200 is configured to control the operations of the compressor 150 and the main fan 180. Upon detection of an abnormal state of the auxiliary fan 185, the compressor 150 is stopped to prevent the heat pump system from being unstably driven. Alternatively, a rotation speed of the main fan 180 may be increased to supply a larger amount of air to the condenser.

Figure 4:
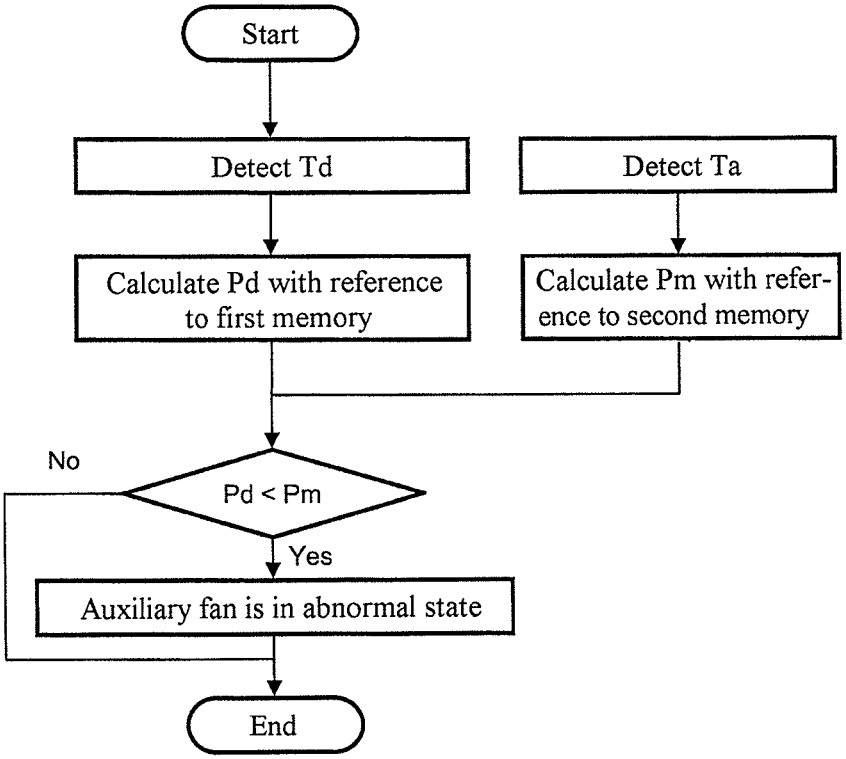
FIG. 4 is a flowchart illustrating processes of detecting whether an auxiliary fan is in an abnormal state or not.

With reference to FIG. 4, will be explained a method for determining whether the auxiliary fan is in an abnormal state or not. FIG. 4 is a flowchart illustrating processes of detecting whether the auxiliary fan is in an abnormal state or not.

Referring to FIG. 4, a discharge side temperature (Td) of the compressor and a peripheral temperature (Ta) of the condenser are detected by the two temperature sensors 136 and 137. Then, a discharge side pressure (Pd) of the compressor and a maximum allowable pressure (Pm) are calculated based on the detected temperatures. Then, the calculated values are compared with each other. If the discharge side pressure (Pd) of the compressor is less than the maximum allowable pressure (Pm) ($Pd<Pm$), it is determined that the auxiliary fan normally operates. On the other hand, if the discharge side pressure (Pd) is more than the maximum allowable pressure (Pm) ($Pd>Pm$), it is determined that the auxiliary fan is in an abnormal state.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising:

a drum configured to accommodate therein an object to be dried;

a first flow path of air exhausted from the drum;

a second flow path of air supplied into the drum;

a first fan provided in the first flow path;

a second fan provided in the second flow path;

a heat pump system to heat the air supplied into the drum, wherein the heat pump system includes an evaporator provided at the first flow path, a condenser provided at the second flow path, an expander, and a compressor; and a controller configured to control a flow rate of air flowing in the second flow path based on a pressure of a refrigerant in the condenser, wherein the controller is configured to increase a rotational speed of the first fan to increase an amount of air supplied to the condenser when the pressure of the refrigerant in the condenser is more than a predetermined maximum allowable pressure.

2. The apparatus of claim 1, wherein the controller is configured to control the flow rate of the air flowing in the second flow path based on a temperature of the refrigerant in the condenser.

3. The apparatus of claim 1, wherein the controller calculates the pressure of the refrigerant based on a temperature of the refrigerant in the condenser.

4. The apparatus of claim 1, wherein the pressure of the refrigerant is measured at a point between the compressor and the condenser.

5. The apparatus of claim 1, wherein the controller is configured to control an operation of the compressor based on a temperature of the refrigerant in the condenser.

6. The apparatus of claim 1, wherein the controller is configured to control an operation of the compressor based on the pressure of the refrigerant in the condenser.

7. The apparatus of claim 6, wherein the pressure of the refrigerant is measured at a point between the compressor and the condenser.

8. The apparatus of claim 6, wherein the controller calculates the pressure of the refrigerant based on a temperature of the refrigerant in the condenser.

9. The apparatus of claim 1, further including a heater provided in the second flow path.

10. The apparatus of claim 1, wherein the controller is configured to calculate the maximum allowable pressure (Pm) based on a peripheral temperature (Ta) of the condenser and to compare the calculated maximum allowable pressure (Pm) with a pressure (Pd) of the refrigerant in the condenser, and wherein the controller determines whether the second fan operates or not based on the comparison.

11. The apparatus of claim 10, wherein the controller determines that the second fan does not operate when the pressure (Pd) of the refrigerant in the condenser is higher than the maximum allowable pressure (Pm).

12. The apparatus of claim 1, wherein the first flow path includes an air outlet duct and the second flow path includes an air inlet duct.

13. A method for operating a clothes treating apparatus, wherein the apparatus includes a drum configured to accommodate therein an object to be dried, a first flow path of air exhausted from the drum, a second flow path of air supplied into the drum, a first fan provided in the first flow path, a second fan provided in the second flow path, and a heat pump system to heat the air supplied into the drum, wherein the heat pump system includes an evaporator provided at the first flow path, a condenser provided at the second flow path, an expander, and a compressor, the method comprising:

controlling, by a controller, a flow rate of air flowing in the second flow path based on either a pressure of a refrigerant in the condenser or a temperature of the refrigerant in the condenser, wherein the controller is configured to increase a rotational speed of the first fan to increase an amount of air supplied to the condenser when the pressure of the refrigerant in the condenser is more than a predetermined maximum allowable pressure.

14. The method of claim 13, further including calculating, by the controller, the pressure of the refrigerant based on the temperature of the refrigerant in the condenser.

15. The method of claim 13, further including measuring the pressure of the refrigerant at a point between the compressor and the condenser.

16. The method of claim 13, wherein the first flow path includes an air outlet duct and the second flow path includes an air inlet duct.

17. A method for operating a clothes treating apparatus, wherein the apparatus includes a drum configured to accommodate therein an object to be dried, a first flow path of air exhausted from the drum, a first fan provided in the first flow path, a second flow path of air supplied into the drum, a second fan provided in the second flow path, and a heat pump system to heat the air supplied into the drum, wherein the heat pump system includes an evaporator provided at the first flow path, a condenser provided at the second flow path, an expander, and a compressor, the method comprising:

controlling an operation of the compressor based on either a pressure of a refrigerant in the condenser or a temperature of the refrigerant in the condenser; and increasing a rotational speed of the first fan to increase an amount of air supplied to the condenser when the pressure of the refrigerant in the condenser is more than a predetermined maximum allowable pressure.

18. The method of claim 17, further including measuring the pressure of the refrigerant at a point between the compressor and the condenser.

19. The method of claim 17, further including calculating the pressure of the refrigerant based on the temperature of the refrigerant in the condenser.

20. The apparatus of claim 17, wherein the first flow path includes an air outlet duct and the second flow path includes an air inlet duct.

* * * * *